US009850063B2

(12) United States Patent
Huber

(10) Patent No.: US 9,850,063 B2
(45) Date of Patent: Dec. 26, 2017

(54) FREIGHT FLOOR, FREIGHT CONTAINER, USE OF A MULTILAYER PANEL TO PRODUCE A FREIGHT FLOOR, AND METHOD FOR PRODUCING A FREIGHT FLOOR

(75) Inventor: Thomas Huber, Schliersee (DE)

(73) Assignee: Telair International GmbH (DE)

( * ) Notice: Subject to any disclaimer, the term of this patent is extended or adjusted under 35 U.S.C. 154(b) by 0 days.

(21) Appl. No.: 14/123,571

(22) PCT Filed: Jun. 6, 2012

(86) PCT No.: PCT/EP2012/060719
§ 371 (c)(1),
(2), (4) Date: Dec. 3, 2013

(87) PCT Pub. No.: WO2012/168310
PCT Pub. Date: Dec. 13, 2012

(65) Prior Publication Data

US 2014/0097181 A1 Apr. 10, 2014

(30) Foreign Application Priority Data

Jun. 7, 2011 (DE) ..... 10 2011 050 893

(51) Int. Cl.
*B65D 88/00* (2006.01)
*B65D 88/14* (2006.01)
*B65D 90/02* (2006.01)

(52) U.S. Cl.
CPC ..... *B65D 88/14* (2013.01); *B65D 90/022* (2013.01); *Y10T 428/249951* (2015.04)

(58) Field of Classification Search
CPC ..... B65D 88/14; B65D 90/022
USPC ..... 220/1.5, 592.2, 592.26, 592.25, 626
See application file for complete search history.

(56) References Cited

U.S. PATENT DOCUMENTS 2,744,042 A * 5/1956 Pace ..... B29C 44/186 105/360
4,162,341 A * 7/1979 Norton ..... 428/117
4,538,663 A 9/1985 Looker
5,067,257 A * 11/1991 Coomer ..... 36/93
5,218,176 A * 6/1993 Meyer, Jr. ..... H04R 1/021 181/151
5,941,405 A 8/1999 Scales et al.
6,835,430 B2 * 12/2004 Morii et al. ..... 428/40.1
(Continued)

FOREIGN PATENT DOCUMENTS

DE 2064241 12/1970
DE 3409683 A1 9/1985
(Continued)

OTHER PUBLICATIONS

International Search Report with Written Opinion in PCT application PCT/EP2012/060719, dated Sep. 7, 2012.
(Continued)

*Primary Examiner* — Fenn C Mathew
*Assistant Examiner* — Don M Anderson
(74) *Attorney, Agent, or Firm* — Barnes & Thornburg LLP

(57) ABSTRACT

A freight floor having a multilayer construction and that is formed as a composite material, comprising a core layer of carbon-fiber-reinforced and/or glass-fiber-reinforced plastic and a seating layer of a metal alloy, in particular an aluminum alloy.

4 Claims, 3 Drawing Sheets

(56) References Cited

U.S. PATENT DOCUMENTS

| | | | | |
|---|---|---|---|---|
| 7,217,453 | B2 * | 5/2007 | Johnson et al. | 428/292.1 |
| 7,584,863 | B2 * | 9/2009 | Bucher et al. | 220/1.5 |
| 2009/0303671 | A1 * | 12/2009 | Aslin | 361/679.01 |
| 2010/0178517 | A1 * | 7/2010 | Pouchelon et al. | 428/429 |
| 2010/0270318 | A1 * | 10/2010 | Dagher et al. | 220/660 |
| 2011/0247753 | A1 * | 10/2011 | Mahoney et al. | 156/277 |
| 2013/0161331 | A1 * | 6/2013 | Pherson | 220/560.01 |

FOREIGN PATENT DOCUMENTS

| | | | |
|---|---|---|---|
| DE | 4331836 | A1 | 3/1995 |
| DE | 69702821 | T2 | 5/2001 |
| DE | 69616182 | T2 | 6/2002 |
| DE | 69630193 | T2 | 6/2004 |
| DE | 102008005010 | A1 | 10/2008 |
| DE | 102007035228 | A1 | 11/2008 |
| EP | 0520745 | A1 | 12/1992 |
| JP | 07257683 | A | 9/1995 |
| WO | 2000/21861 | A2 | 4/2000 |
| WO | 20091057899 | A2 | 5/2009 |
| WO | WO2010045572 | A1 | 4/2010 |

OTHER PUBLICATIONS

English translation of International Preliminary Report on Patentability and Written Opinion, dated Dec. 10, 2013 in PCT Application PCT/EP2012/060719.

* cited by examiner

FREIGHT FLOOR, FREIGHT CONTAINER, USE OF A MULTILAYER PANEL TO PRODUCE A FREIGHT FLOOR, AND METHOD FOR PRODUCING A FREIGHT FLOOR

RELATED APPLICATIONS

This patent application is a U.S. nationalization under 35 U.S.C. §371 of International Application No. PCT/EP2012/060719, filed Jun. 6, 2012, which claims priority to German Patent Application No. 10 2011 050 893.7, filed Jun. 7, 2011.

BACKGROUND AND SUMMARY

The present invention concerns a freight floor, a freight container, a use of a multilayer panel to produce a freight floor, and a method for production of a freight floor.

Freight containers and freight pallets are essential for effective transport of loads in aircraft as they allow rapid loading and unloading of the aircraft. The great majority of commercial aircraft can receive a multiplicity of freight containers or freight pallets. Most containers or pallets are standardised so they can be used irrespective of the aircraft used for their transport. Until ten years ago, freight containers were made exclusively of aluminium, wherein the own weight of the container was around 100 kg. Some containers used at present partly comprise lighter materials so that now, freight containers with a weight of around 60 kg are used. It is evident that reducing the own weight of the containers or pallets used brings substantial financial and ecological benefits. Freight containers are known for example from DE 69 702 821 T2, U.S. Pat. No. 5,941,405, DE 20 64 241 and DE 102 008 005 010 A1. The use of textiles or fabrics (see U.S. Pat. No. 4,538,663) or non-metallic materials (see JP 07257683 A, DE 69616182 T2 and DE 3409683 A1) in this context has also been considered.

In the construction of a freight container or freight pallets, the design of the freight floor is essential. The entire weight of the cargo to be loaded rests thereon. Furthermore the freight containers or freight pallets are often parked incorrectly, so that in some cases very high spot loads act on the freight floors Freight containers and freight pallets are parked and locked fully automatically or partly automatically at a predefined position on the cargo deck of the aircraft. Roller drive units (PDUs: Power Drive Unit) or freight drive units are let into the cargo deck to drive the freight container and freight pallets. These freight drive units have rollers which are coated with an elastomer (e.g. rubber) and rest on the freight floor to apply corresponding forces. In the construction of freight containers it is therefore necessary to design the freight container floor or freight floor such that sufficient force can be transmitted by means of the rollers. Here again, high forces act on part regions of the freight floor, which can lead to rapid wear.

Starting from said prior art, the object of the present invention is to provide a freight container with an improved freight floor, and a corresponding freight floor alone. In particular the new freight floors and freight containers should be lighter, functionally usable and robust.

This object is achieved by a freight floor according to the present disclosure.

In particular this object is achieved by freight floor with at least one core layer of carbon-fibre-reinforced and/or glass-fibre-reinforced and/or aramide-fibre-reinforced plastic, and a seating layer (support layer) of metal alloy, in particular an aluminium alloy, wherein a composite material can be used.

An essential concept of the present invention is to reduce the weight of the freight floor by making this of several layers, in particular in a sandwich construction, wherein materials of metal and plastic are used for the layers. Predefined requirements, e.g. good friction and wear behaviour, can be taken into account here, wherein as a whole a very stable composite material or laminate is produced.

Preferably the layers are joined together by material and/or form fit, wherein a material fit leads to particularly good results.

The freight floor can comprise a multiplicity of core layers. These core layers can form a core. The core layers can be fibre-reinforced, wherein a first core layer can have a first fibre orientation which differs from a second fibre orientation of a second core layer. For example two core layers can be arranged such that the first fibre orientation differs from the second fibre orientation by an absolute angle of at least 20 or 30 or 40 or 45°, or 90°. The absolute angle can be defined such that this is the smallest absolute angle value between two fibre orientations.

At least one core layer can comprise a fibre network of carbon fibres and/or glass fibres and/or aramide fibres. The fibres within a fibre network can run substantially at right angles to each other to form a grid network. A corresponding core layer is particularly durable. Also the core layers with fibre networks can be arranged such that the fibre orientations of two core layers differ by 20 or 30 or 40 or 45°, or 90°. These angles can also be interpreted as absolute angles.

The freight floor can comprise at least one core layer with a foam layer. Here a foam layer with cellular structure and low density can be used. The foam can be at least partly saturated with synthetic resin. Because of the foam, the cargo hold floor according to the invention has a low weight, wherein the synthetic resin reinforces the construction.

The foam layer can comprise a supporting structure. Preferably this supporting structure extends vertically to the cargo hold floor so that this firmly joins together the layers lying on the foam layer. The supporting structure can be formed from a synthetic resin. The supporting structure can have a rectangular or honeycomb-shaped or round form in order to absorb forces acting vertically.

The foam layer can be interposed between a first core layer of carbon-fibre-reinforced and/or glass-fibre-reinforced and/or aramide-fibre-reinforced plastic and a second core layer of carbon-fibre-reinforced and/or glass-fibre-reinforced and/or aramide-fibre-reinforced plastic. Preferably the individual layers are joined together by material fit. For example, the layers can be connected by synthetic resin. Preferably the foam layer has the supporting structure already described, which extends substantially perpendicular to the fibre direction or fibre directions of the first and second core layers.

At least one core layer can have a connecting layer on the side facing the seating layer. This connecting layer can serve to connect the corresponding core layer or core to the seating layer. Preferably said layer is the core layer which is arranged directly adjacent to the seating layer. The connecting layer can be made from an elastomer. Preferably this connecting layer serves firstly to connect the seating layer to the core or core layers. Furthermore the connecting layer compensates for a different thermal expansion between the core with the at least one core layer and the seating layer. This can be advantageous on production of the cargo hold floor according to the invention, or if it is exposed to strong temperature fluctuations during use.

Alternatively or additionally, an adhesive, in particular a polyurethane adhesive, can be used to connect the seating layer to the core layer.

The connecting layer can be joined to the core layer and/or the seating layer by material fit, in particular by vulcanisation.

Preferably the seating layer of metal alloy serves as an outer layer for the action of the freight drive units. Furthermore this layer absorbs spot loads and distributes them over a broad area. An aluminium alloy is particularly suitable here since this gives a good coefficient of friction in conjunction with conventional rollers of freight drive units. The core layers reinforce the entire construction and lead to substantial weight savings.

The seating layer can have a thickness of 0.5 mm to 2.5 mm, in particular 0.7 mm to 1.5 mm, in particular 0.9 mm to 1.5 mm. Preferably the seating layer has only a slight thickness in relation to the thickness of the entire freight floor, e.g. less than 40%, in particular less than 30%, in particular less than 20% of the total thickness. To this extent, significantly lighter freight floors can be produced.

The seating layer can have a strength of more than 400 $N/mm^2$, in particular more than 500 $N/mm^2$. To this extent the seating layer can protect the core layer from high spot loads. The freight floor according to the invention wears only slowly under the usual rough handling and is very robust.

It is possible to design the freight floor in a multilayer structure with only two layers. Preferably however a further layer, namely a wearing layer or top layer, can be provided which is arranged on the side of the core layer facing away from the seating layer.

The wearing layer can be made of metal alloy, in particular an aluminium alloy, and/or a glass fibre-reinforced plastic and/or a material from the group of aromatic polyamides (e.g. aramide). The wearing layer can protect the core layer from wear and stiffen the sandwich construction as a whole.

Said aluminium alloys for the seating layer and/or the wearing layer can be aluminium wrought alloys. The main alloy element used can be zinc, wherein zinc accounts for a proportion of 0.7 to 13%, in particular 0.8 to 12%. Such aluminium alloys are very hard. For example 7075 T6 or 7075 T7 can be used as a material.

Also an aluminium wrought alloy can be used with the main alloy element copper, wherein copper can account for a proportion of 0.5 to 9%, in particular 0.7 to 8%. In addition to the materials 7075 T6, 7075 T7 cited above, for example materials such as 2024 T3/T4, 2026 T3511, 2056 T3, 2524 T3, 5052, 6061 T4, 7075 T761 or 7475 T61 are conceivable. 2024 T3/T4, 2056 T3 or 2524 T3 have particularly good properties since these materials provide adequate reinforcement for the cargo hold floor and have a long life under load.

Preferably the wearing layer is also connected to the core layer by form and/or material fit.

Said aluminium alloys can be aluminium alloys with a solution-hardened and/or thermally hardened and/or over-hardened heat treatment, to ensure an adequate strength.

The core layer can have a thickness of at least 1 mm, in particular at least 1.5 mm, in particular at least 2 mm, in particular at least 4 mm, in particular at least 6 mm.

In one embodiment example, the core layer comprises a solid core. According to the application, a solid core is a core which is substantially solid. This means that the core layer comprises at least 50%, in particular at least 70%, in particular at least 90% carbon-fibre-reinforced and/or glass-fibre-reinforced plastic. There are no large cohesive cavities, in particular honeycomb structures or similar.

The wearing layer can have a thickness of 0.1 mm to 1 mm, in particular 0.2 mm to 0.6 mm, in particular 0.25 mm to 0.5 mm.

In addition, said object is achieved by a freight container with a freight floor as has already been described, and side walls arranged on the freight floor. Similar advantages arise for the freight container as already described in connection with the freight floor.

The freight floor can have a peripheral edge profile at least in portions, in particular in the form of a bead, to connect the side walls to the cargo hold floor. Finally, the cargo hold floor can be formed such that it has a peripheral edge which can then be inserted in the peripheral container corner profiles, so that no rivets are required to connect the floor to the side walls.

The side walls at least in portions can be made of glass-fibre-reinforced and/or carbon-fibre-reinforced plastic.

Said object is furthermore achieved by the use of a multilayer panel, comprising a core layer of carbon-fibre-reinforced and/or glass-fibre-reinforced and/or aramide-fibre-reinforced plastic, and a seating layer of metal alloy, in particular an aluminium alloy, for production of a freight floor, and by a corresponding production method.

The production method may include the following steps:

- Production of a core with at least one core layer of carbon-fibre-reinforced and/or glass-fibre-reinforced and/or aramide-fibre-reinforced plastic;
- Production of a seating layer of a metal alloy, in particular an aluminium alloy;
- Connection of the seating layer with the at least one core layer by material connection and/or by material fit.

Preferably the method is suitable for production of a cargo hold floor as has already been described.

The seating layer can be connected to the core layer by application and/or vulcanisation of a connecting layer from the group of elastomers.

The core can be made from a multiplicity of core layers. Preferably the core layers comprise at least two core layers of carbon-fibre-reinforced and/or glass-fibre-reinforced and/or aramide-fibre-reinforced plastic, wherein the fibre orientation of the individual core layers differs.

To reduce the weight, a core layer of the core can comprise a foam, in particular with a supporting structure.

The core layers can be joined together by application of a synthetic resin. Preferably the plastic is hardened at temperatures between 100 and 200°, in particular between 150 and 180°. The core layer or layers can be hardened at the same time as the seating layer is joined to the core. For example the thermal energy applied to harden the core can be used to connect an at least partly non-vulcanised rubber to the seating layer and the core. Alternatively an adhesive can be used to create the connection between the seating layer and the core layer. For example a polyurethane adhesive can be used to join the layers together.

BRIEF DESCRIPTION OF THE DRAWINGS

The invention is described below with reference to several embodiment examples which will be explained in more detail with reference to drawings. The drawings show.

DESCRIPTION

Figure 1:
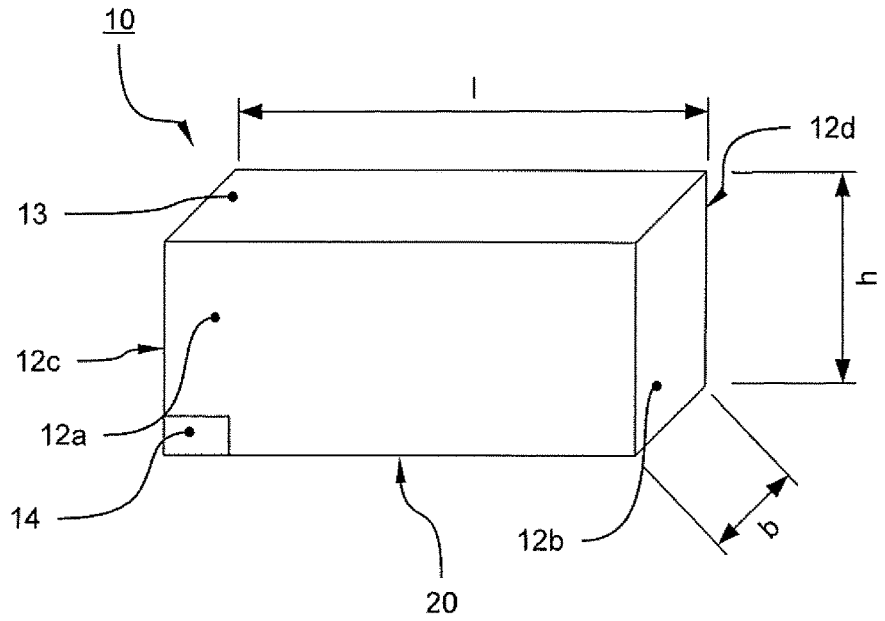
FIG. 1 a diagrammatic view of a freight container with a floor plate and side walls.

In the description which follows, the same reference numerals are used for parts which are the same and parts which have the same effect.

FIG. 1 shows a cuboid freight container 10 having a freight container height h, a freight container width b and a freight container length 1.

The freight container 10 has a floor plate 20 which is arranged opposite a cover plate 13 and can be regarded as an embodiment of the freight floor according to the invention. The casing surface of the cuboid freight container 10 is formed by the side walls 12*a* to 12*d*, in particular a first side wall 12*a*, a second side wall 12*b*, a third side wall 12*c* and a fourth side wall 12*d*. The side walls 12*a* to 12*d* are arranged in pairs opposite each other.

Figure 2:
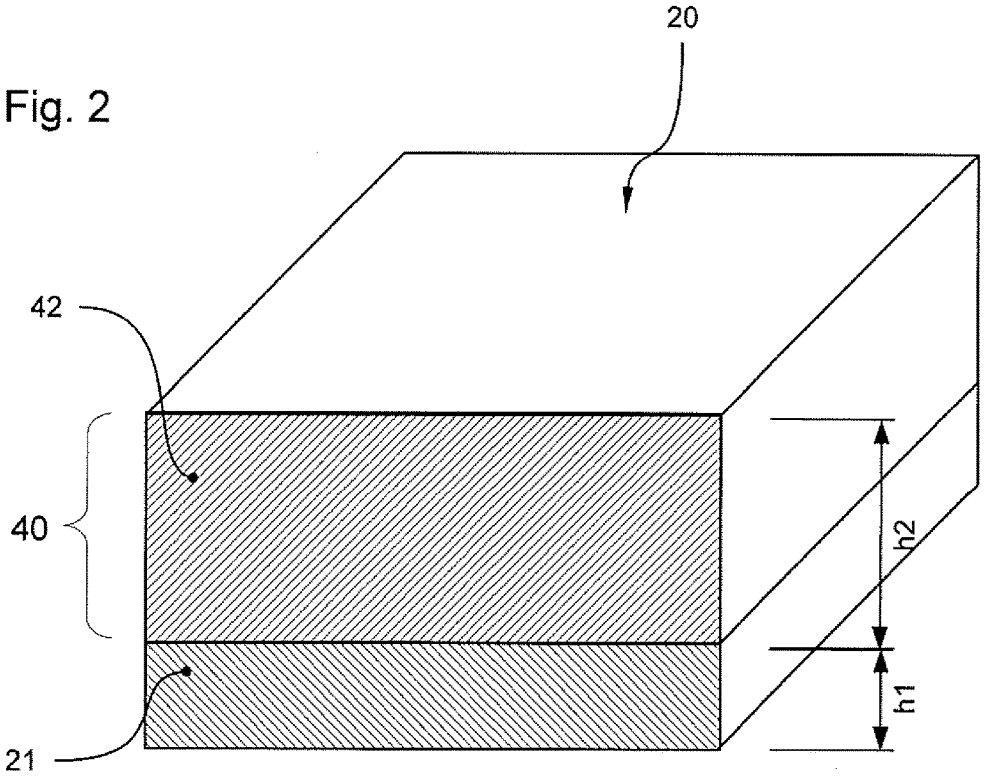
FIG. 2 a cross section through the floor plate in FIG. 1.

FIG. 2 shows a cross-section through the floor plate 20 of the freight container 10. In the embodiment example shown in FIG. 2, the floor plate 20 has a multilayer structure with a seating layer 21 and a core 40. The seating layer 21 forms the bottom layer and is connected flush with the core 40 by material connection, wherein the core lies on the seating layer 21. The floor plate 20 is constructed as a composite material, wherein the core 40 consists of a core layer, namely a CFRP layer 42 (carbon-fibre-reinforced plastic), and the seating layer 21 consists of an aluminium alloy (e.g. a material known as 7075 T6 or 2024 T3/T4). The seating layer 21 has a seating layer thickness h1 of 1 mm and the CFRP layer 42 has a core layer thickness h2 of at least 2 mm. Preferably the aluminium alloy has a strength of at least 500 $N/mm^2$. With this construction, it is possible to achieve a weight reduction of the floor plate 20 of around 35% to 50%, wherein existing requirements (e.g. good force connection with rollers of freight transport devices, high stability) are fulfilled. Since the majority of the weight of a conventional freight container 10 still lies in the floor plate 20, the overall weight is thus significantly reduced. On transport of the freight container 10 by aircraft, this leads to a significant fuel saving which again results in lower CO2 emissions.

Figure 3:
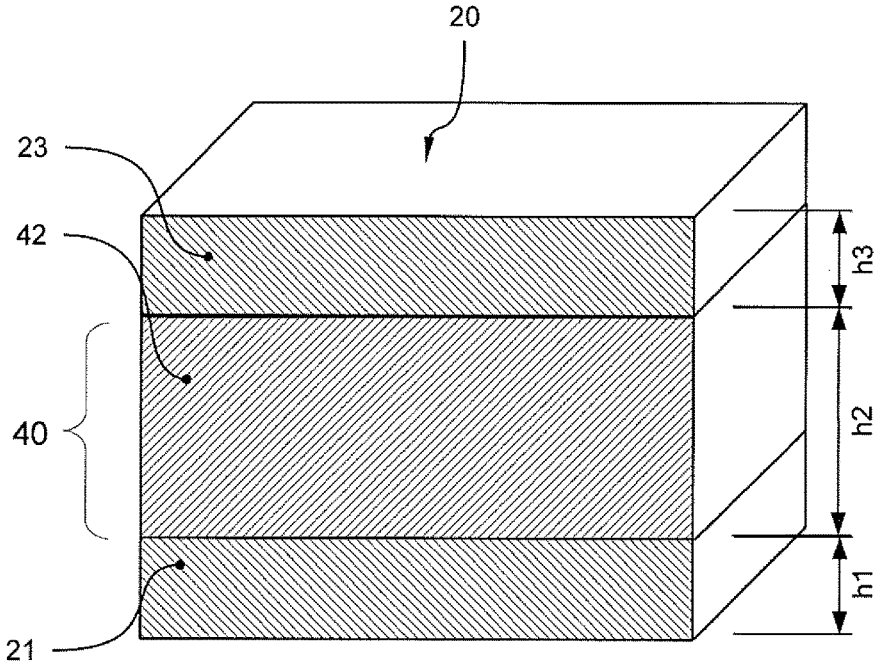
FIG. 3 a three-layer embodiment of the floor plate from FIG. 1.

FIG. 3 shows a further embodiment example of the floor plate 20 which is made of three layers. In a sequence from top to bottom, this floor plate 20 has a wearing layer 23, a core 40 consisting of a CFRP layer as a core layer, and a seating layer 21. The wearing layer 23 can be made of glass-fibre-reinforced plastic or aramide. The seating layer 21 is made of a metal alloy, preferably an aluminium alloy. A wearing layer thickness h3 amounts to around 0.25 to 0.5 mm, while the core layer thickness h2 is around 3 mm and the seating layer thickness h1 around 1 mm.

This design of the floor plate 20 as a sandwich panel has the advantage that the at least one core layer (e.g. CFRP layer 42) is protected by the wearing layer 23. Furthermore the multilayered structure leads to an increase in stability of the entire floor plate 20. In a further embodiment example, the wearing layer 23 can also be made of aluminium alloy, e.g. 7075 T7 or 7075 T6. Theoretically a steel plate can also be used, wherein however an electrically non-conductive layer is preferred since this has no influence on any RFID tag 14 (see FIG. 1) which may be provided on or in the freight container 10.

Figure 4:
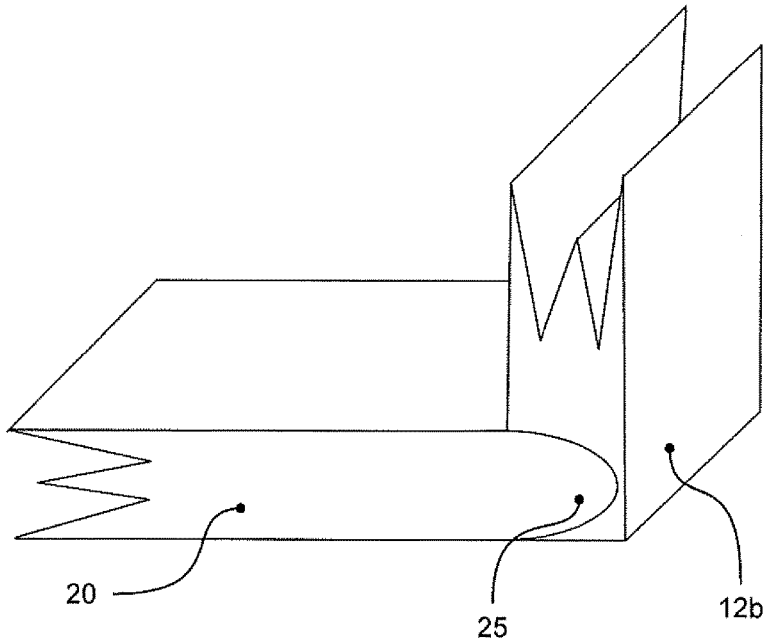
FIG. 4 a cross section of an edge region of the freight container from FIG. 1.

The floor plate 20 according to the invention preferably has a peripheral floor plate profile 25 (FIG. 4) which can be inserted in a container corner profile to attach the floor plate 20 to the side walls 12*a* to 12*d*. Therefore no additional fixing means, e.g. a weld connection or rivets, is required.

The freight container 10 according to the invention preferably has a floor plate 20 which is equipped with a seating layer 21 on the bottom that is made from a metal alloy, in particular an aluminium alloy. This means that existing freight decks of aircraft with corresponding freight transport devices can be used to transport the freight containers 10 without problems relating to the coefficient of friction on action of the rollers provided. The freight containers 10 according to the invention can therefore be used universally.

Preferably the floor plate 20 is also formed in at least two layers, in particular three layers, and as a composite material or laminate. The individual layers, in particular the seating layer 21 and/or the core layer and/or the wearing layer 23, are connected together by material or form fit, wherein a material fit connection is preferred. A connection between the individual layers can be created directly or indirectly.

In the embodiments described, the cuboid embodiment of the freight container 10 has been discussed in detail. For the person skilled in the art, it should be evident that the form of the freight container 10 is given merely as an example and can be arbitrary. Common freight containers 10 have a chamfer in the upper region in order to adapt optimally to the cargo hold of an aircraft.

Figure 5:
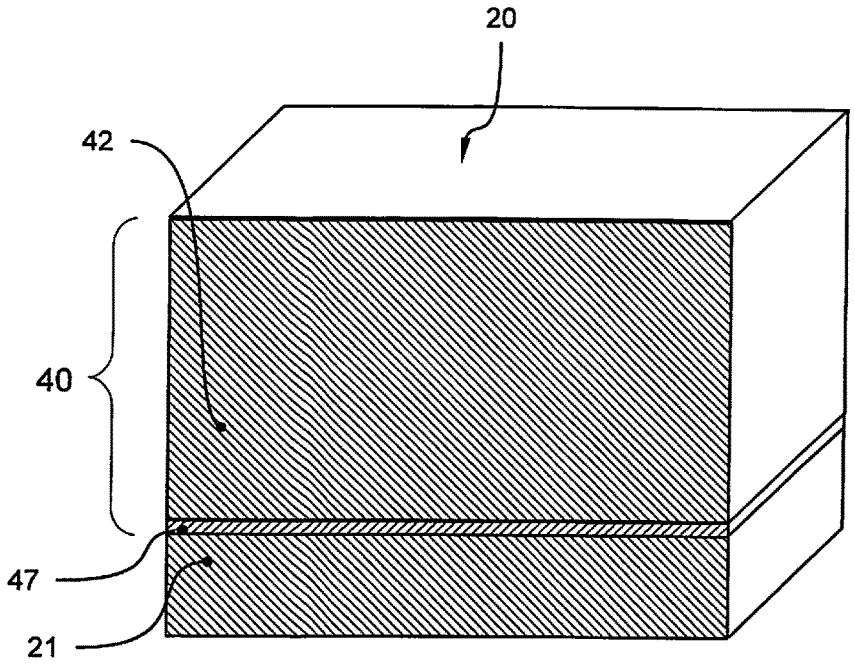
FIG. 5 a cross-section through an alternative embodiment of the floor plate (single-layer core with connecting layer)
Figure 6:
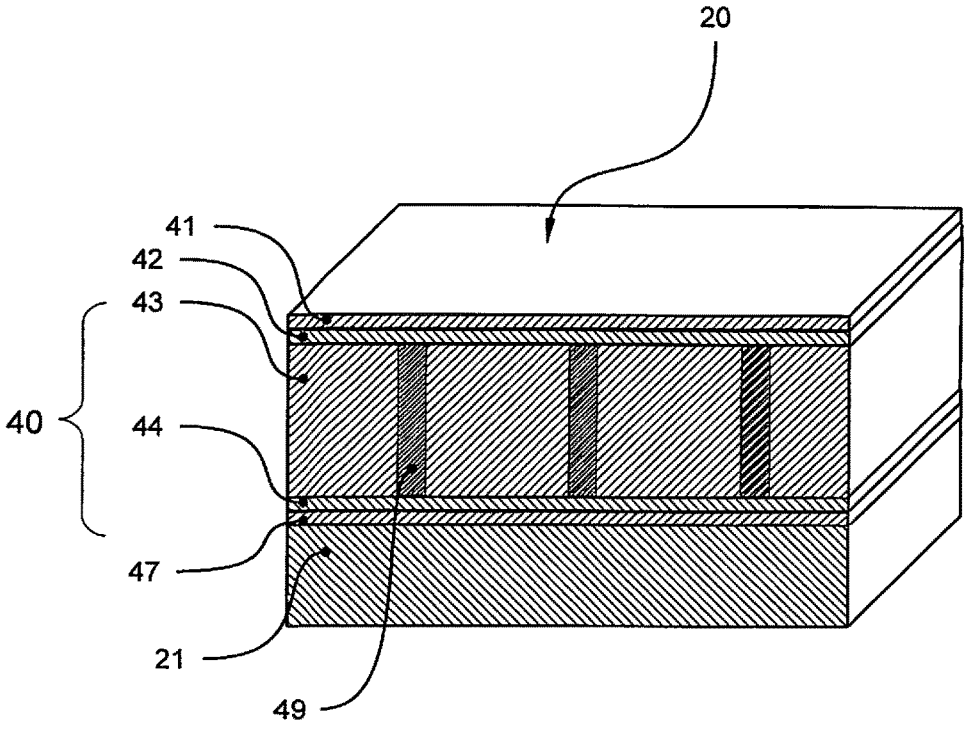
FIG. 6 a cross-section through an alternative embodiment of a floor plate (multilayer core with connecting layer).

Further embodiment examples of the cargo hold floor 20 according to the invention are shown in FIGS. 5 and 6.

FIG. 5 shows a cargo hold floor 20 which has a core 40 and a seating layer 21 of aluminium alloy. The core 40 is made from a CFRP layer 42 and is connected to the seating layer 21 via a rubber layer 47. The rubber layer 47 can be glued to the CFRP layer 42 and/or the seating layer 21. A PU adhesive could also be used. Alternatively, the rubber layer 47 can be vulcanised onto the seating layer 21 and/or the CFRP layer 42.

A further embodiment example is shown in FIG. 6. The core 40 in this example is made multilayered and connected to the seating layer 21 via a rubber layer 47 as a connecting layer. The core 40 comprises a foam layer 43, wherein on alternate sides of the foam layer 43 can be arranged a first CFRP layer 42 and the second CFRP layer 44. The foam layer 43, the first CFRP layer 42 and the second CFRP layer 44 are glued together by a synthetic resin. Preferably the foam layer 43 has honeycomb-shaped cavities which allow the hardened synthetic resin to create a direct material connection between the first CFRP layer 42 and the second CFRP layer 44. To this extent, the foam layer 43 encased by the CFRP layers 42, 44 is particularly suitable for absorbing vertical loads, without this leading to a compression of the core 40. The hardened synthetic resin in the cavities of the foam layer 43 thus forms a supporting structure 49. A GFRP layer 41 is arranged on the side of the first CFRP layer 42 facing away from the seating layer 21. This GFRP layer 41 can be a wearing layer 43 which protects the first CFRP layer 42 from wear. It is possible to glue the GFRP layer to the core 40 during its production.

The CFRP layer 42 can have a first network of glass fibres and the first CFRP layer 42 can have a second network of plastic fibres, wherein the fibres of the first network are arranged at a 45° angle to the fibres of the second network. Therefore the following structure could result: +45/−45° GFRP layer, 0/90° CFRP layer, foam core (e.g. Rohacell), 0/90° CFRP layer.

The first CFRP layer 42 can for example have thickness of 0.2 mm to 0.6 mm, in particular 0.4 mm. The foam layer 43 can have a thickness of 1.0 to 8.0 mm, in particular 1.8 to 6.0 mm. The second CFRP layer 44 can have similar or identical thickness conditions to the first CFRP layer 42. The seating layer 21 in the embodiment example shown has a thickness of 1.0 to 1.5 mm and consists of 2024 T3.

In one embodiment example, a metal layer e.g. of aluminium is arranged on both sides of a core, e.g. a core 40, as described above. The layers can be connected together by gluing and/or vulcanizing. This sandwich arrangement has the advantage that the floor plate 20 only deforms slightly under temperature fluctuations. The production process is also simple, since the seating layer 21 and the wearing layer 23 of metal or a metal alloy can be connected to the core 40, e.g. glued, in one production step. In one embodiment example, the layers can be connected at a temperature (e.g. greater than 20°, greater than 30°, greater than 40°).

The embodiment of a freight container and the floor plate 20 used therein have been described above. According to the invention, a method is also provided for production of a corresponding floor plate 20 or a freight container floor, and a production method for production of a freight container 10. For example, a method for production of a freight container floor can comprise the following steps:

- Production of the core layer 22 of carbon-fibre-reinforced and/or glass-fibre-reinforced plastic;
- Production of a seating layer 21 of a metal alloy, in particular the aluminium alloy described above;
- Connection of the seating layer 21 with the core layer 22 by material connection and/or by material fit.

Said production steps can take place before the layers are connected. Theoretically however it is also conceivable first to produce one of the layers and then to construct the further layer on this base layer. For example the aluminium alloy can form the base layer on which the core layer 22 with the carbon-fibre reinforcement and/or glass-fibre reinforcement and/or aramide-fibre reinforcement is produced successively.

Furthermore in the method according to the invention, a wearing layer 23 can be applied. Here again it is possible first to produce the seating layer 21, the core layer 22 and the wearing layer 23, and then create a material fit connection between the individual layers. Alternatively the seating layer 21 and the wearing layer 23 can be produced, and the core layer 22 constructed successively on the seating layer 21 and/or the wearing layer 23. The composite material can be formed by joining together the seating layer 21 with or without core layer 22, and the wearing layer 23 with or without core layer 22.

It should be evident to the person skilled in the art that numerous alternative embodiments exist for the production method. Similarly it should be evident to the person skilled in the art how a freight container 10 according to the invention can be produced. Furthermore the person skilled in the art should know how to produce the freight floor as part of a freight pallet.

A plurality of embodiments are described below for implementing the invention.

Embodiment 1.1

Freight floor comprising:

a core layer 42, 43, 44 of carbon-fibre-reinforced and/or glass-fibre-reinforced and/or aramide-fibre-reinforced plastic, and a seating layer 21 of a metal alloy, in particular an aluminium alloy, wherein the core layer 42, 43, 44 and the seating layer 21 are connected together by material fit and/or by form fit.

Embodiment 1.2

Freight floor according to embodiment 1.1,
characterised in that
the seating layer 21 has a thickness h1 of 0.5 mm to 2.5 mm, in particular 0.7 mm to 1.5 mm, in particular 0.9 mm to 1.5 mm.

Embodiment 1.3

Freight floor according to any of the preceding embodiments,
characterised in that
the seating layer 21 has a strength of more than 400 N/mm$^2$, in particular more than 500 N/mm$^2$.

Embodiment 1.4

Freight floor according to any of the preceding embodiments,
characterised by
a wearing layer 23 or top layer which is arranged on the side of the core layer 42, 43, 44 facing away from the seating layer 21, wherein the wearing layer 23 and the core layer 42, 43, 44 are preferably connected together by material fit and/or by form fit.

Embodiment 1.5

Freight floor according to any of the preceding embodiments, in particular embodiment 4,
characterised in that
the wearing layer 23 is formed from a metal alloy, in particular an aluminium alloy, and/or a glass-fibre-reinforced plastic and/or a material from the group of aromatic polyamides.

Embodiment 1.6

Freight floor according to any of the preceding embodiments
characterised in that
at least one of the aluminium alloys is an aluminium wrought alloy with the main alloy element zinc, in particular with 0.7 to 13.0% zinc, in particular 0.8 to 12.0% zinc.

Embodiment 1.7

Freight floor according to any of the preceding embodiments
characterised in that
at least one of the aluminium alloys is an aluminium alloy with a solution annealed and/or artificially aged and/or overhardened heat treatment.

Embodiment 1.8

Freight floor according to any of the preceding embodiments,
characterised in that
the core layer 42, 43, 44 has a thickness h2 of at least 1 mm, in particular at least 1.5 mm, in particular at least 2 mm.

Embodiment 1.9

Freight floor according to any of the preceding embodiments,
characterised in that
the core layer 42, 43, 44 comprises a solid core Embodiment 1.10

Freight floor according to any of the preceding embodiments,
characterised in that
the wearing layer 23 has a thickness of 0.1 mm to 1 mm, in particular 0.2 mm to 0.6 mm, in particular 0.25 mm to 0.5 mm.

Embodiment 2.1

Freight container, comprising a freight floor according to any of the preceding embodiments and side walls 12*a*-12*d* arranged on the freight floor 20.

Embodiment 2.2

Freight container according to embodiment 2.1, characterised in that
the freight floor 20 at least in portions comprises a peripheral edge profile 25, in particular in the form of a bead, for connecting the side walls 12*a*-12*d* to the freight floor 20.

Embodiment 2.3

Freight container according to embodiment 2.1 or 2.2, characterised in that
the side walls 12*a*-12*d* at least in portions are made from glass-fibre-reinforced and/or carbon-fibre-reinforced plastic.

Embodiment 3

Use of a multilayer panel comprising:
a core layer 42, 43, 44 of carbon-fibre-reinforced and/or glass-fibre-reinforced plastic, and
a seating layer 21 of a metal alloy, in particular an aluminium alloy, for production of a freight floor 20 in particular according to any of embodiments 1.1 to 1.10.

Embodiment 4

Method for production of a freight floor, in particular a freight floor 20 according to any of embodiments 1.1 to 1.10, comprising the steps:
production of the core layer 42, 43, 44 of carbon-fibre-reinforced and/or glass-fibre-reinforced plastic;
production of a seating layer 21 of a metal alloy, in particular an aluminium alloy;
connection of the seating layer 21 with the core layer 42, 43, 44 by material connection and/or by material fit.

LIST OF REFERENCE NUMERALS

10 Freight container
12*a* to 12*d* Side wall
13 Cover plate
14 RFID tag
20 Floor plate
21 Seating layer
23 Wearing layer
25 Floor plate profile
40 Core
41 GFRP layer
42 CFRP layer
43 Foam layer
44 CFRP layer
47 Rubber layer
h Freight container height
b Freight container width
1 Freight container length
h1 Seating layer thickness
h2 Core layer thickness
h3 Wearing layer thickness

The invention claimed is:

1. A freight floor comprising:
first and second core layers of fibre-reinforced plastic,
a foam layer arranged between the first core layer and the second core layer, the foam layer including foam and a plurality of cavities in the foam layer,
a seating layer of a metal alloy, wherein one of the core layers and the seating layer are connected together by material fit and/or by form fit,
wherein the foam layer comprises foam and a supporting structure made of synthetic resin, the supporting structure being formed in the cavities of the foam layer and extending vertically to the freight floor and firmly joining the first and second core layers, the synthetic resin of the supporting structure joining the first core layer and the second core layer by material fit, wherein the foam has a low density and is at least partially saturated with the synthetic resin to reinforce the freight floor.

2. The freight floor of claim 1, wherein the first core layer and the second core layer of fibre-reinforced plastic each comprise a fibre network of carbon fibres.

3. The freight floor of claim 1, wherein the foam layer has a thickness of 1.0 to 8.0 mm.

4. The freight floor of claim 1, wherein the seating layer comprises an aluminum metal alloy having a thickness of 0.5 mm to 2.5 mm.

* * * * *